US005722321A

United States Patent [19]

Szyszko et al.

[11] Patent Number: 5,722,321

[45] Date of Patent: Mar. 3, 1998

[54] BLADE MOUNTING ASSMBLY FOR SREEN PRINTING APPARATUS

[75] Inventors: Alexander Szyszko, Bloomington; Ryszard Witowski, Wheaton, both of Ill.

[73] Assignee: Elexon Ltd., Elk Grove Village, Ill.

[21] Appl. No.: 732,041

[22] Filed: Oct. 16, 1996

[51] Int. Cl.[6] ..... B41F 15/44

[52] U.S. Cl. ..... 101/123; 101/129; 101/169; 15/256.5

[58] Field of Search ..... 101/114, 120, 101/123, 124, 129, 157, 169; 15/256.5, 256.51, 256.53

[56] References Cited

U.S. PATENT DOCUMENTS

| | | | |
|---|---|---|---|
| 3,780,670 | 12/1973 | Abler et al. | 101/157 |
| 4,349,934 | 9/1982 | Margittai | 15/256.51 |
| 4,940,354 | 7/1990 | Holderegger et al. | 101/169 |
| 4,989,512 | 2/1991 | Lindstrom et al. | 101/123 |
| 4,995,316 | 2/1991 | Kolblin et al. | 101/123 |
| 5,001,979 | 3/1991 | Kurten | 101/123 |

*Primary Examiner*—Ren Yan

*Attorney, Agent, or Firm*—Fitch, Even, Tabin & Flannery

[57] ABSTRACT

A blade mounting assembly for squeegee or flood bar blades of screen printing machines is provided which includes a clamping mechanism connected to a mounting bar that releasably secures the blade assembly to the bar and over a printing screen mounted in the machine. When released, the clamping mechanism herein stays attached to the mounting bar and allows for quick and easy blade assembly replacement operations. In addition, the clamping mechanism is readily adapted to be used with mounting bars provided in screen printing machines and with blade holders that are currently clamped to the mounting bars with U-clamps. Preferably, the clamping mechanism is a spring plate which can be toggled between clamped and unclamped positions by the printer with one hand. Other forms of clamping mechanisms can include screw and air clamps for releasably securing the blade assemblies to the mounting bar of the screen printing machine.

20 Claims, 8 Drawing Sheets

192
22
78
26
140
26
86
20
10

BLADE MOUNTING ASSMBLY FOR SREEN PRINTING APPARATUS

FIELD OF THE INVENTION

The invention relates to a blade mounting assembly for a screen printing apparatus and a method for mounting blade assemblies in the screen printing apparatus and, more particularly, to a clamping method and mechanism for squeegee or flood bar blade assemblies of the screen printing apparatus.

BACKGROUND OF THE INVENTION

In known types of screen printing machines, blade assemblies are used to distribute ink across the screen in a flooding operation and to force the ink through the screen onto the substrate to be printed in the pattern dictated by the stencilling formed on the screen in a printing operation. Both the flooding and printing operations can be performed by a single blade assembly which is moved in opposite directions for the respective flooding and printing strokes. Separate blade assemblies can also be provided with the flooding operation being performed by a flood bar blade assembly and the printing operation by a squeegee blade assembly having a blade which can be formed of rubber, elastomeric or the like material so as to resiliently engage the screen to force ink therethrough during a printing stroke across the screen.

For supporting the flood bar blade or squeegee blade in their movement across the screen, blade holders can carry the flood bars and squeegee blades with the blade holders being clamped to a mounting bar of a printing carriage which can be manually moved or driven across the printing screen in the screen printing machine. Typically, the blade holder is clamped up against the bottom of the mounting bar by inverted U-shape clamps along the length of the mounting bar and holder. For clamping of the blade assemblies, and particularly the holders thereof to the mounting bar, the holder can be provided with an enlarged mounting head which allows the lower ends of the clamp legs to engage under opposed projecting flanges or mounting ears of the holder mounting head and apply an upward clamping force thereto so as to clamp the top of the holder against the bottom of the mounting bar. The inverted U-shaped clamps are provided with thumb screws which have threaded shanks extending through the clamp into a channel formed between the leg members thereof. At their lower end, the shanks engage the top of the mounting bar so that upon tightening of the screw, the bottoms of the clamp legs are drawn up into clamping engagement under the flanges of the holder for moving the top of the holder up against the bottom of the bar in clamping engagement therewith with the holder being tightly captured between the bottom of the thumb screw shank and mounting bar on its top and the lower ends of the clamp legs under the holder flanges. In this manner, an upwardly directed force substantially perpendicular to the mounting bar is applied to the blade holder for clamping it against the mounting bar.

A considerable amount of force must be applied to the squeegee blade and blade holder to prevent their shifting relative to a support bar on a squeegee carriage during screen printing operation. The squeegee and its blade holder should be held and retained in a precise position on the bar of the squeegee carriage. Hence, whatever mechanism is used it must secure the squeegee holder tightly to the bar to make sure that the blade holder does not shift in a vertical or horizontal direction during use. The above described prior art apparatus precisely positions and applies sufficient force to hold the blade holder during the blade usage in a screen printing operation; but it suffers a number of shortcomings, as described below.

The screen printer is faced with several variables which they must consider and control for obtaining the best print quality in an efficient, cost-effective manner. For printing during a printing stroke, the printing blade assembly is inclined toward the direction of travel across the screen, thereby bringing the leading edge of the squeegee blade into contact with the screen to force ink therethrough while the trailing edge of the blade is raised off of the screen. Thus, during a printing stroke, the resilient blade is applied to the screen with a certain pressure and is bent or deflected for pushing ink through the screen. It is also desirable that the blade not be too flexible and has sufficient stiffness so that the leading edge of the blade is presented in line contact with the screen to "cut off" the ink more cleanly at the screen mesh line, thereby providing more uniform and consistent printing results from one printing stroke to the next with the blade. If the blade is too flexible and is deflected too much when engaged with the screen, the sharp corner and leading edge of the blade may not be doing the desired cutting off of the ink at the screen mesh line. Therefore, screen printers carefully select the blade to be utilized so that it has the requisite stiffness and regularly change blade assemblies when different blade resiliencies are required for different printing jobs.

Other variables to be considered include such things as the type of substrate being printed, the speed at which the blade is drawn across the printing screen, the type of printing ink utilized, the screen type utilized and the amount of ink to be applied to the substrate. With thicker, more viscous inks, greater pressure may be required on the squeegee to force the desired amount of ink through the printing screen. In this instance, a stiffer, less flexible squeegee may be desired. Also, temperature and humidity conditions can have some effect on the printing pressure, as will screen fabrics. The amount of ink applied to the substrate can vary with the surface characteristics of the substrate material which can require widely varying printing pressures to assure good printing quality having the desired sharpness and detail.

Thus, the blade assemblies are subjected to varying printing conditions. As is apparent, the screen printer needs to be able to change blade assemblies in a quick and efficient manner to be able to adapt to the specific requirements of a particular job, such as where squeegee blades of differing levels of flexibility or resilience are required for particular applications, or where the blade has worn, such as at the leading edge thereof. Blade assembly replacement operations with U-shaped clamps require that the thumb screws be loosened to remove the clamping force exerted on the upper mounting flanges of the blade holder. The clamps can then be slid along the bar to a position along the length of the holder intermediate the ends thereof where access slots have been milled on either side of the holder in the holder mounting flanges. At this position, the clamp legs can be slid up and off from the holder and removed from the mounting bar.

As is apparent, the use of the U-clamps requires a fairly slow, time consuming process for changing blade assemblies. The holders are typically extruded aluminum pieces and subsequent milling of the access slots in the mounting flanges thereof is undesirable in terms of the inconvenience and the expense associated with doing this. The clamps also have to be disengaged from the mounting bar and stored.

During blade replacement operations, there is a risk that either the loose clamps or the unclamped blade assemblies could fall down onto the screen, potentially damaging the screen and image formed thereon. Thus, there is a need for a blade mounting assembly and a clamping mechanism which releasably secures the blade assembly over the screen and provides for easy, quick and safe blade assembly replacement operations.

SUMMARY OF THE INVENTION

In accordance with the present invention, a blade mounting assembly which is moved across the printing screen and releasably secures the blade assembly over the printing screen in a screen printing machine is provided and includes a clamping mechanism connected to the mounting bar of the screen printing apparatus and which stays therewith during blade assembly replacement operations. The clamp member can be moved between a clamping position where it pushes and clamps the holder against the mounting bar and a release position where the clamp member is moved from the clamping position to allow the blade holder to be disengaged from the mounting bar for changing and replacing the blade assembly with another blade assembly without requiring sliding of the clamp member along the mounting bar, as required with the previous U-shaped clamps. The present clamp member does not have to removed from the bar for changing blade assemblies, thus eliminating the problem of having the clamp potentially falling onto the screen and causing damage thereto during blade assembly replacement operations. Moreover, because the clamp member is provided with a storage position when it is released as it stays connected to the mounting bar in the release position, there is no time lost in removing clamps from the screen printing apparatus or retrieving the clamps for attaching blade assemblies thereto. In addition, no additional milling of the holder is required after it is extruded to provide it with access slots for allowing the clamp members to be attached and removed from the holder for changing of blade assemblies such as necessary with the U-clamps. Thus, the present clamping mechanism is a significant improvement over the use of the previously-described U-clamps in terms of the safety and time saved during blade replacement operations which increases the efficiency of screen printing operations and can add up to significant cost savings in the overall screen printing process.

The clamping mechanism precisely positions the blade holder on the blade support bar of the blade carriage and applies sufficient force to retain the blade holder against shifting in either a horizontal or a vertical direction during a screen printing operation. The clamping mechanism is inexpensive and simple to use.

In one form, the mounting bar has a pivot member for pivotally mounting the blade holder to pivot the holder against the bar with the clamp member in the clamping position and to pivot the holder away from the bar with the clamp member in the release position. The blade holder typically has an upper portion or mounting head and a lower portion from which the blade of the blade assembly depends. The pivot member can have a hook end below the mounting bar which prevents movement of the holder upper portion down away from the bottom of the mounting bar and prevents sliding of the upper portion along the bottom of the mounting bar with the clamp member in the clamping position. In the clamp release position, the holder upper portion can be pivoted about the hook end to move the holder away from the mounting bar for replacing blade assemblies. The blade mounting assembly herein is readily adaptable to being retrofit for use with current mounting bars for blade assemblies provided on screen printing machines. The clamping mechanism in particular is also readily adaptable to be used for clamping blade holders that are currently used in blade assemblies and clamped with the previously-described U-clamps. In this regard, the clamping member can be attached at one side of the mounting bar for engaging one of the flanges or clamp engaging portion of the blade holder and the pivot member can be attached at the other side of the mounting bar for engaging the other flange or pivotally mounted portion of the blade holder without requiring any significant modifications to the bar already in the screen printing machine and the blade holders currently used with the previously-described U-shaped clamps.

Preferably, the clamp member is a spring plate pivotally mounted to the mounting bar so as to exert a spring bias clamping force in the clamping position to urge the holder upper portion against the mounting bar. Pivoting of the spring plate away from the mounting bar and holder to the clamp release position removes the spring bias clamping force from the blade holder allowing the holder to be pivoted away from the mounting bar for replacing blade assemblies. The pivoting action of the spring plate can be easily performed by the screen printer and, in fact, can be done with one hand and does not require the printer to undertake special precautions with respect to having to worry about the clamp falling onto the printing screen below during blade assembly replacement operations.

In this regard, the mounting bar can include a stop for limiting the pivoting of the spring plate which allows the plate to disengage from the holder and hang over the printing screen spaced outwardly from the mounting bar at a predetermined distance therefrom without engaging the screen during blade assembly replacement operations.

Other clamping mechanisms according to the present invention can include a screw clamp which is screwed down in the clamping position and, in one form, may be provided with cam surfaces for engaging the holder and applying the clamping force thereto or an air clamp such as a double-acting cylinder which can be spring loaded and/or pressurized in the clamp locking position with either one of the screw and air clamps pushing the holder upper portion at least horizontally against the mounting bar in the clamping position. When the cam surface is used with the screw clamp, the cam surface pushes the holder both vertically and horizontally when the screw clamp is tightened in the clamping position.

The blade for use with the blade mounting assembly of the present invention can be either the flexible squeegee for pushing printing ink through the screen as it is drawn across the screen in a printing operation, or also, such as where separate blades are used for printing and flooding strokes, the flood bar which is moved downward spaced above the screen in engagement with the ink to distribute it across the screen in a flooding operation prior to printing.

Another aspect of the invention is a method of releasably mounting squeegee or flood bar blade assemblies in the screen printing apparatus by engaging the holder of the blade assembly with the clamping mechanism to apply a clamping force thereto and pivoting the holder towards the mounting bar about the pivot member upon engagement and application of the clamping force to the holder for clamping of the holder to the mounting bar. Preferably, the clamping mechanism has a spring plate for exerting a spring bias clamping force to the holder to clamp it to the mounting bar.

In one form, the screen plate can clamp the holder to the mounting bar by pivoting of the spring plate up to a substantially perpendicular position relative to the mounting bar for applying the spring bias clamping force to the blade holder. The spring plate can be pivoted down and outwardly from the mounting bar from the perpendicular position to a predetermined position where it hangs in spaced relation over the printing screen and is disengaged from the holder to remove the spring bias clamping force therefrom. The blade assembly is replaced with a new blade assembly by pivoting the holder about the holder about the pivot member downwardly away from the mounting bar to disengage the holder therefrom.

DETAILED DESCRIPTION OF THE PREFERRED EMBODIMENTS

Figure 1:
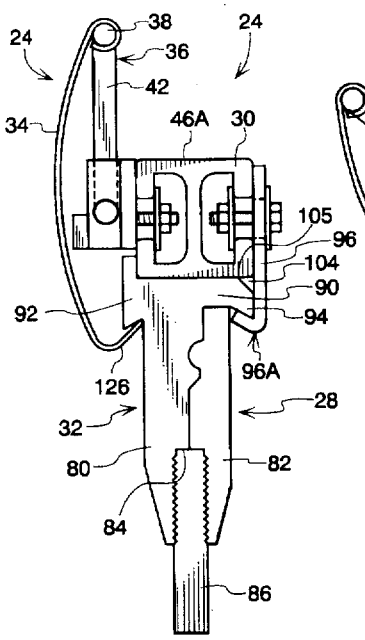
FIG. 1 is an elevational view of the blade mounting assembly according to the present invention and including a blade assembly and a clamping mechanism and showing the clamping mechanism in the form of a spring plate clamp member which is in its clamping position clamping the blade holder of the blade assembly against a mounting bar of a screen printing apparatus.

As shown in the drawings for purpose of illustration, the invention is for a screen printing apparatus 10 (FIGS. 4–6) which can have pallets 12 carrying substrates 14 such as textiles, e.g., T-shirts or sweatshirts, through a series of printing stations at which printing heads 16 are located for printing on the substrates 14. Each of the printing heads can have a squeegee and flood bar carriage 18 that reciprocates in its associated printing head for distributing ink on a printing screen 20 mounted in a screen holder or chase 22 under which the pallet 12 and substrate 14 thereon is positioned and for forcing ink through the screen 20 to form an image on the substrate 14 therebelow.

In accordance with the present invention, a blade mounting assembly 24 is provided and includes a clamping mechanism 26 which releasably secures a blade assembly 28 above the printing screen 20 in the screen printing apparatus 10. The clamping mechanism 26 is adapted to be used with mounting bars 30 which are currently utilized in screen printing machines with U-shaped clamps for clamping the blade assembly 28 thereto. Further, the clamping mechanism 26 is connected to the mounting bar 30 such that when it is moved from the clamping position, such as shown in FIG. 1, to the unclamped, release position of FIG. 3, the clamping mechanism 26 need not be slid along the bar 30 and removed therefrom as it stays with the bar 30 as it is moved between the clamping and release positions. Thus, the present blade mounting assembly 24 obviates the need to provide storage for the clamps during blade replacement operations and the danger of clamps falling onto the screen 20 therebelow during such replacement operations. In addition, no access slots have to be made in the holder 32 because the clamping mechanism 26 stays connected to the bar 30 when replacing blade assemblies 28, as will be more fully described herein.

In addition to utilizing the mounting bars 30 currently provided in screen printing machines, the clamping mechanism 26 herein is adapted for use with current blade holders 32 which are configured for clamping by the prior U-shaped clamps described earlier. Thus, the blade mounting assembly herein, and particularly the clamping mechanism 26 thereof, is able to be readily retrofit to current screen printing machines for use with the mounting bars 30 therein and the holders 32 of current blade assemblies 28.

Figure 2:
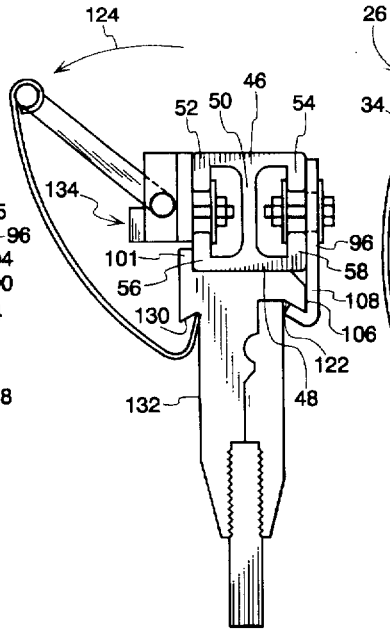
FIG. 2 is a view of the blade assembly similar to FIG. 1 showing the spring plate clamp member pivoted towards a release position for releasing the spring bias clamping force on the holder.
Figure 3:
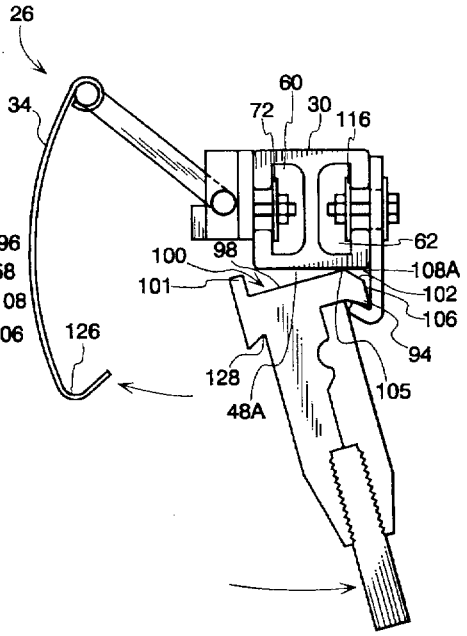
FIG. 3 is a view similar to FIGS. 1 and 2 showing the spring plate clamp member pivoted to the release position and out of engagement with the blade holder and the blade holder pivoted about a pivot member on the mounting bar to move the blade assembly out of engagement therewith.
Figure 7:
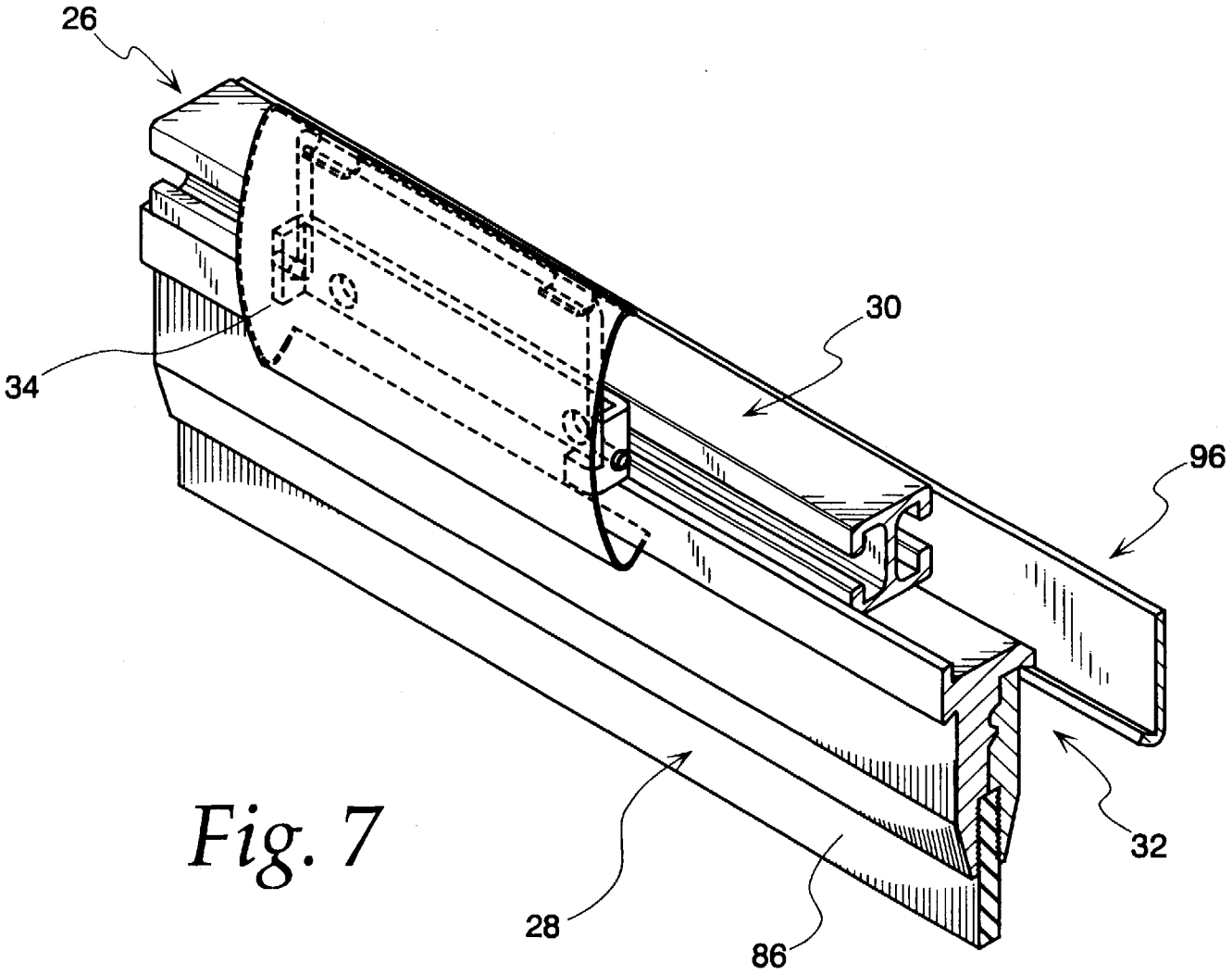
FIG. 7 is a perspective view of the blade mounting assembly of FIG. 1.
Figure 8:
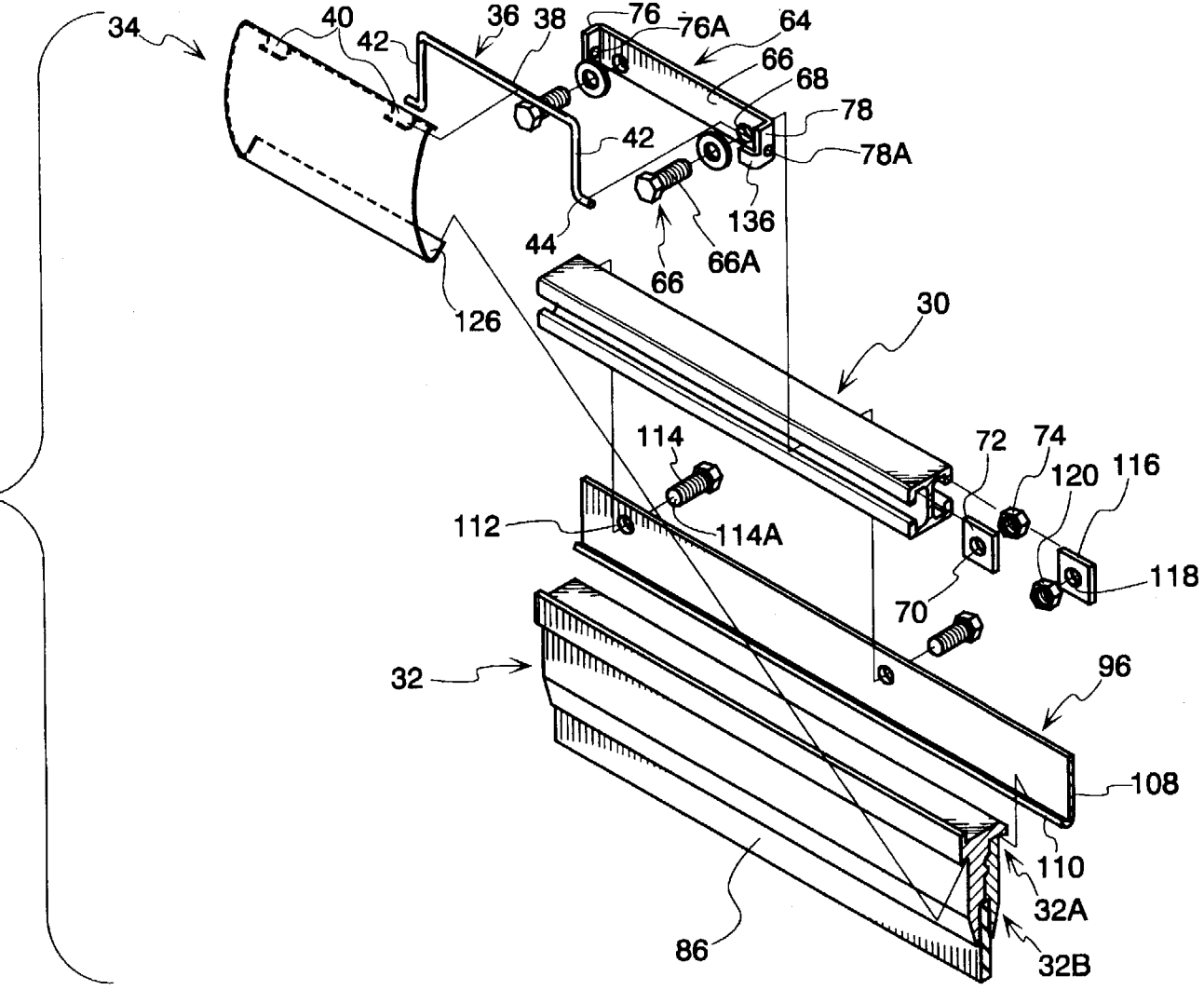
FIG. 8 is an exploded view of the blade mounting assembly of FIG. 7.

Referring more specifically to FIGS. 1–3, 7 and 8, the preferred form of a clamping mechanism 26 connected to mounting bar 30 for clamping blade assembly 28 thereto is illustrated. As best seen in FIGS. 7 and 8, the preferred clamping mechanism 26 has a clamp member 34 which is in the form of a spring plate. As seen in FIGS. 1–3, the spring plate 34 is adapted to be pivoted by way of bail handle 36 between the clamping position and release position. The spring plate 34 is connected to an elongate rod portion 38 of the handle 36 via latches 40 provided at the upper end of the plate 34. The handle 36 has leg portions 42 at either end of the rod portion 38 at the bottom of which are mounting feet 44 about which the handle 36 and attached spring plate 34 are pivoted. The elongate rod portion 38 has a slightly greater length than the distance between the two latch portions 40, as best seen in FIG. 7. The rod portion 38 can be press fit between the latches 40 and upper end of the spring plate 34 for connecting the plate 34 to the handle 36.

The mounting bar 30 is substantially H-shaped in cross section with an upper horizontal leg 46 and a lower horizontal leg 48 connected by an intermediate center vertical web 50 extending therebetween. The upper horizontal leg 46 has vertically depending lips 52 and 54 on either side thereof, and the lower horizontal leg 48 includes upwardly extending vertical lips 56 and 58 on either side thereof. In this manner, the mounting bar 30 defines T-slots 60 and 62 on either side of the central web 50.

The handle 36 can be anchored to the H-bar 30 by a bracket 64 which is fastened or bolted to the bar 30 adjacent the T-slot 60. The bracket 64 includes a flat wall portion 66 which is abutted against the outer sides of the lips 52 and 56 and secured thereagainst by fasteners 66. The fasteners 66 are inserted through mounting holes 68 formed in the wall portion 66 and through aligned holes 70 formed in fastener receiving members 72 provided in the T-slot 60 with a nut 74 fit on the protruding end of a threaded shank **66*a* of the fastener 66 and screwed down tightly against the back side of the members 72**.

The bracket 64 includes opposite tabs 76 and 78 formed integrally with the vertical wall 66 and at right angles thereto at either end thereof. The tabs 76 and 78 each include respective foot mounting apertures **76*a* and 78*a* into which the mounting feet 44 of the bail handle 36 are pivotally mounted. Thus, the spring plate 34 can be pivoted relative to the mounting bar 30 by gripping the rod portion 38 of the bail handle 36 and pulling or pushing thereon so as to rotate the mounting feet 44 in their respective pivot apertures 76*a* and 78*a***.

As previously mentioned, the holder 32 can be of conventional construction having an upper portion **32*a* to be clamped to the bar 30 and a lower portion 32*b* from which the blade 86 can depend. Preferably, the holder 32 is formed from two cooperating plate members 80 and 82 of extruded aluminum which can be attached together as by bolting or the like. At their lower ends, the plate members cooperate to define a blade receiving channel 84 in which a squeegee 86 can be secured. The plate members 80 and 82 are preferably provided with serrated surfaces in the form of sawtooth projections and recesses 88 in the channel 84 which aid the holder 32 in maintaining a secure, captive engagement with the printing blade over a wide range of printing pressures. If desired, squeegee blade 86 may also be provided with sawtooth recesses on either side thereof. The serrated surfaces will bite into the elastomeric material of the squeegee blade and clamp the blade against shifting relative to the plate members 80 and 82 of the holder 32**.

The upper portion **32*a* of the holder can be in the form of an enlarged mounting head 90 which can be formed on plate 80 with flanges or portions 92 and 94 formed on either side thereof. The portion 92 is a clamp engaging portion to which the clamping mechanism applies a clamping force for clamping the holder 32 against the mounting bar 30. The portion 94 is a pivotally mounted portion and pivots about a pivot member 96, and particularly a lower hook end 96*a* thereof as the clamping mechanism 26 is moved between clamping and release positions. More specifically, the clamp engaging portion 92 of the holder 32 is substantially vertically oriented and cooperates with the upper surface 98 of the holder 32 to form a right angle corner therewith which tightly abuts up against lip 56 and lower leg 48 when the clamping mechanism 26 is moved to the clamped position. The pivotally mounted portion 94 is oriented so as to angle downwardly from the top surface 98 and is provided with a chamfered or bevelled clearance providing surface 102 so as to be readily able to cooperate with the hook end 96*a* of the pivot member 96 for pivoting about the hook 96*a*. The chamfer on the surface 102 provides a clearance space 104 for the pivotally mounted portion 94, and particularly the vertical outer surface 106 thereof so that it can move from abutment with the pivot member 96 in the clamped position through the clearance space 104 for pivoting the pivotally mounted portion 94 about the hook end 96*a* and the holder 32 out of engagement with the mounting bar 30. As the vertical surface 106 is moved through the clearance space 104, the juncture 105 of the chamfered surface 102 and holder upper surface 98 will be able to be slid along the bar lower leg surface 48*a* until it can be pivoted away from the bar 30**.

The pivot member 96 is in the form of an elongate flat plate 108 having lower integral portion 110 which extends upwardly at an acute angle to the plate 108 from the bottom of the plate 108 to form the hook end **96*a* of the pivot member 96. The plate 108 can include a pair of mounting holes 112 for receiving fasteners 114 which secure the pivot member 96 to the mounting bar 30. The pivot member 96 utilizes fastener receiving members 116 having apertures 118 to cooperate with the fasteners 114 for securing the pivot member 96 to the bar 30 in a manner similar to the attachment of the bracket 64 previously described. Thus, the plate 108 is secured to the outside of the lips 54 and 58 by inserting the fasteners 114 through the mounting holes 112 and into aligned holes 118 of the members 116 which are located in the T-slot 62 with the protruding threaded end of the fasteners shanks 114*a* having a nut 120 screwed down thereon into contact with the back of the members 116 to secure the plate 108 to the lips 54 and 58. With the plate 108 so secured, the lower angled portion 110 thereof is positioned below the lower surface 48*a* of the mounting bar lower leg 48 at a distance which is sufficient to accommodate the pivotally mounted portion 94 between the pivot member lower portion 110 and the bar surface 48*a* with the holder upper surface 98 flush against the surface 48*a* and a downwardly angled surface 122 of the pivotally mounted portion 94 substantially flush against the pivot member angled portion 110, as best seen in FIGS. 1 and 2. As previously mentioned, in this clamped position, the chamfer of the pivotally mounted portion surface 102 provides a clearance space 104 between it and the adjacent portions of the clamp leg surface 48*a* and the inner surface 108*a* of the pivot member plate portion 108**.

It will be appreciated that the use of the separate pivot member 96 and the separate bar allow the retrofitting of existing bars to be converted to allow pivoting of the squeegee blade holder. On the other hand, for new bars 30 the pivot member could be an integral part of an extruded aluminum bar 30.

For clamping of the holder 32 to the bar 30, the spring plate member 34 can be pivoted up to an over-center position with the handle rod portion 38 and attached upper end of the spring plate 34 moving through an arc 124 centered about the handle mounting feet 44 and cooperating tab apertures 76*a* and 78*a*. For clamping in the over-center position, a lower upturned or holder engaging portion 126 of the spring plate 34 seats in a corner channel 128 formed by the bottom 130 of the holder clamp engaging portion 92 and the main vertical outer surface 132 of the holder plate member 80 to apply a spring bias force to lift the clamp engaging portion 92 with an upward pull towards the bar 30. Thus, with the holder pivotally mounted portion 94 supported for pivoting on the pivot member angled portion 110, the spring plate upturned portion 126 seated in the corner channel 128 will be effective to apply a spring bias force having both vertical and horizontal force components when the spring plate 34 is pivoted up to the clamped, over-center position with the bail handle 36 oriented substantially vertically and perpendicular to the outer surface 46*a* of the mounting bar upper leg 46. These forces tend to want to cause the holder portion 94 to pivot off of the bar 30. However, as described earlier, the pivot member 96 is rigidly secured to the bar 30 and oriented so as to keep the pivotally mounted portion clamped between it and bar surface 48*a*.

In practice, with the spring plate lower end 126 engaged in the corner channel 128, such as in FIG. 2, the spring plate 34 will be bowed and placed in compression from its normal or unstressed state, as shown in FIG. 3. Pivoting handle 36 up to the vertical or twelve o'clock position of FIG. 1 lifts the clamp engaging portion 92 so that the holder corner 100 seats tightly against the corner formed between the lip 56 and clamp lower leg outer surface 48*a* flush thereagainst with the spring plate 34 stretched and placed in tension, and thereby applying a spring bias torque force having both horizontal and vertical force components to the holder 32 at the holder corner channel 128 to produce a moment of the torque force at the holder pivotally mounted portion 94 about the rigidly pivot member 94 and particularly the hook end 96*a* thereof.

To release the spring plate clamp 34, the above clamping operation is substantially reversed. The screen printer can simply grab the handle bar 38 with one hand and move it counter-clockwise in the arc 124 to the position of FIG. 2 where the spring plate is no longer in tension and is bowed which more readily allows the holder engaging portion 126 to be slid along the bottom 130 of the holder clamp engaging portion 92 and out of engagement with the holder 32, as shown in FIG. 3. As is apparent, the above-described one-handed toggling of the spring plate 34 between clamped and unclamped positions is a substantially faster and simpler operation than is required for replacing blade assemblies that are clamped with the previously described U-clamps. In addition, to avoid the problem of having loose clamps falling onto the printing screen 20 therebelow, a stop member 134 can be provided for limiting pivoting of the spring plate 34 so that when it is disengaged from the holder 32, it hangs over the screen 20 and is spaced outwardly from the mounting bar 30 at a predetermined distance therefrom so as not to be a hindrance during blade assembly replacement operations. In this manner, the spring plate 34 freely hangs substantially vertically over the screen 20 without danger of engaging or contacting the screen and potentially causing damage thereto during blade replacement operations. The stop member 134 can be formed integrally with either one of the tabs 76 and 78 and is shown as an inward extension 136 of tab 78 so that when the bail handle 36 is pivoted down from the vertical over-center position and outwardly from the mounting bar 30 counter-clockwise along the arc 124, the handle vertical portion 42 will engage the top of the extension 136 to arrest continued pivoting movement of the handle 36 about its mounting feet 44 in arc 124 with the handle being in the position shown in FIGS. 2 and 3.

With the spring plate 34 disengaged from the holder 32, the blade holder 32 can be pivoted out of contact with the bar 30. Specifically, the holder upper surface 98 is moved or pivoted counter-clockwise as shown in FIG. 3 with the corner or juncture 105 formed between the upper surface 98 and chamfered surface 102 riding along the lower leg surface 48*a* until the pivotally mounted portion 94 is pivoted sufficiently to allow it to be removed from engagement with the lower hook end 96*a* of the pivot member 96. The predetermined spacing from the mounting bar 30 afforded by the stop member 134 also positions the spring plate 34 so that its lower end portion 126 hangs at a position so that when the screen printer is ready to reapply the clamp to a blade assembly 28, the lower end 126 is oriented to be easily moved into engagement into the corner 128 of the holder plate 80. In this manner, a relatively simple and easy procedure is provided for clamping and unclamping blade assemblies 28 to the mounting bar 30 which does not require any sliding of the clamping mechanism 26 along the mounting bar and eliminates the risk of loose clamps falling onto the printing screen 20.

Figure 4:
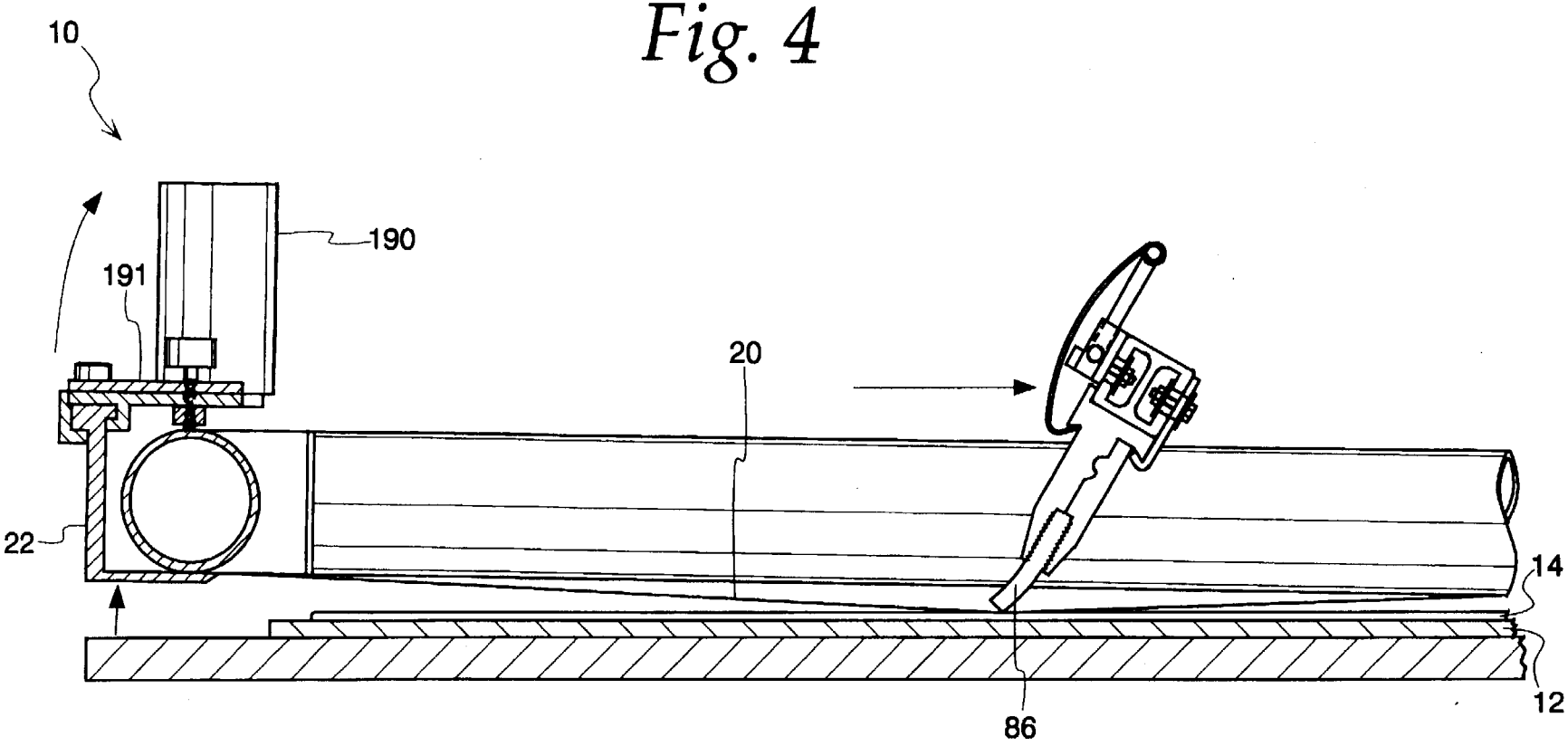
FIG. 4 is an elevational view of the blade assembly clamped to the mounting bar in the screen printing apparatus by the clamping mechanism of FIGS. 1–3 and showing a squeegee blade in the blade assembly resiliently engaging the printing screen as it is moved thereacross to push ink therethrough and onto the substrate therebelow.

The torque force applied by the spring plate clamp 34 in FIG. 1 in the clockwise direction is effective to clamp the pivot holder 32 particularly by the corner 100 thereof against the bar 30 with the corner seating against the lip 56 and lower leg 48. Where the blade assembly 28 carries a squeegee printing blade, such as shown in FIG. 4, the bottom rubbing of the blade 86 against the screen 20 deflects the blade and also creates forces which tend to rotate the squeegee and its holder 32 in a clockwise direction with such rotation resisted by the rigidly mounted pivot member 96. The above-described mating corner arrangement between the holder 32 and mounting bar 30 prevents sliding of the holder to the right in FIGS. 1–3 with the holder mounting head 90 held up against the mounting bar 30 by the fixed hook 96*a* at the pivotally mounted portion 94 and by the spring clamp upturned end 126 at the holder clamp engaging portion 92. When the clamping mechanism 26 herein is also utilized with a flood bar blade assembly 140 (FIG. 5), the spring load provided by the spring plate 34 resists the counter-clockwise forces generated when the flood bar 140 is moved across the printing screen 20 in the opposite direction of that of the movement of the squeegee blade 86. As the flood bar does not engage the printing screen 20 and is not downloaded into resilient engagement with the screen 20, as is the squeegee blade 86, there are little-frictional forces generated during the reverse motion of the flood bar 140. Thus, the spring load of the spring plate is sufficient to resist the counter-clockwise forces generated by movement of the flood bar 140.

It will be seen that the blade holder 32 is precisely positioned in a horizontal direction by the clamping mechanism with upstanding blade holder flange 101 abutting lip 56 (FIG. 2) and vertical outer surface 106 on the blade holder abutting the inner facing surface 108*a* of the flat plate 108 of the pivot member 96. In the vertical direction, the holder upper surface 98 is abutted against the bottom surface 48*a* of leg 48 of the bar 30 with the angled portion 110 of the pivot member exerting an upward force on the right hand end of the blade holder's pivot member portion 94 and the clamping spring plate holder engaging portion 126 hooked into and exerting an upward force on the holder's clamping channel portion 128 on the left-hand side of the blade holder.

Thus, the squeegee blade holder is precisely positioned and held tightly against shifting relative to the bar in both the horizontal and vertical directions.

Referring now to FIGS. 9–15, alternative embodiments of clamping mechanism 26 for use in the present blade mounting assembly 24 are illustrated. In FIGS. 9–12, two different types of screw clamps are shown, one which applies a clamping force having both vertical and horizontal force components against the holder 32 (FIGS. 9 and 10) similar to spring plate 34 with the other exerting a clamping force having only a horizontal force component against the holder 32. The screw clamp 142 of FIGS. 9 and 10 includes a threaded rod 144 which is threaded through a mounting block 146 connected to the mounting bar 30 in substantially the same manner as described for bracket member 64. At the upper end of the rod 144, a clamp turning handle 148 is provided with a gripping portion 150 having an internally threaded annular portion 152 formed at the distal end thereof through which the upper end of the rod 144 extends. At the lower end of the rod 144, a cam member 154 having inclined cam surface 156 is provided.

Figures 9, 10, 11, 12:
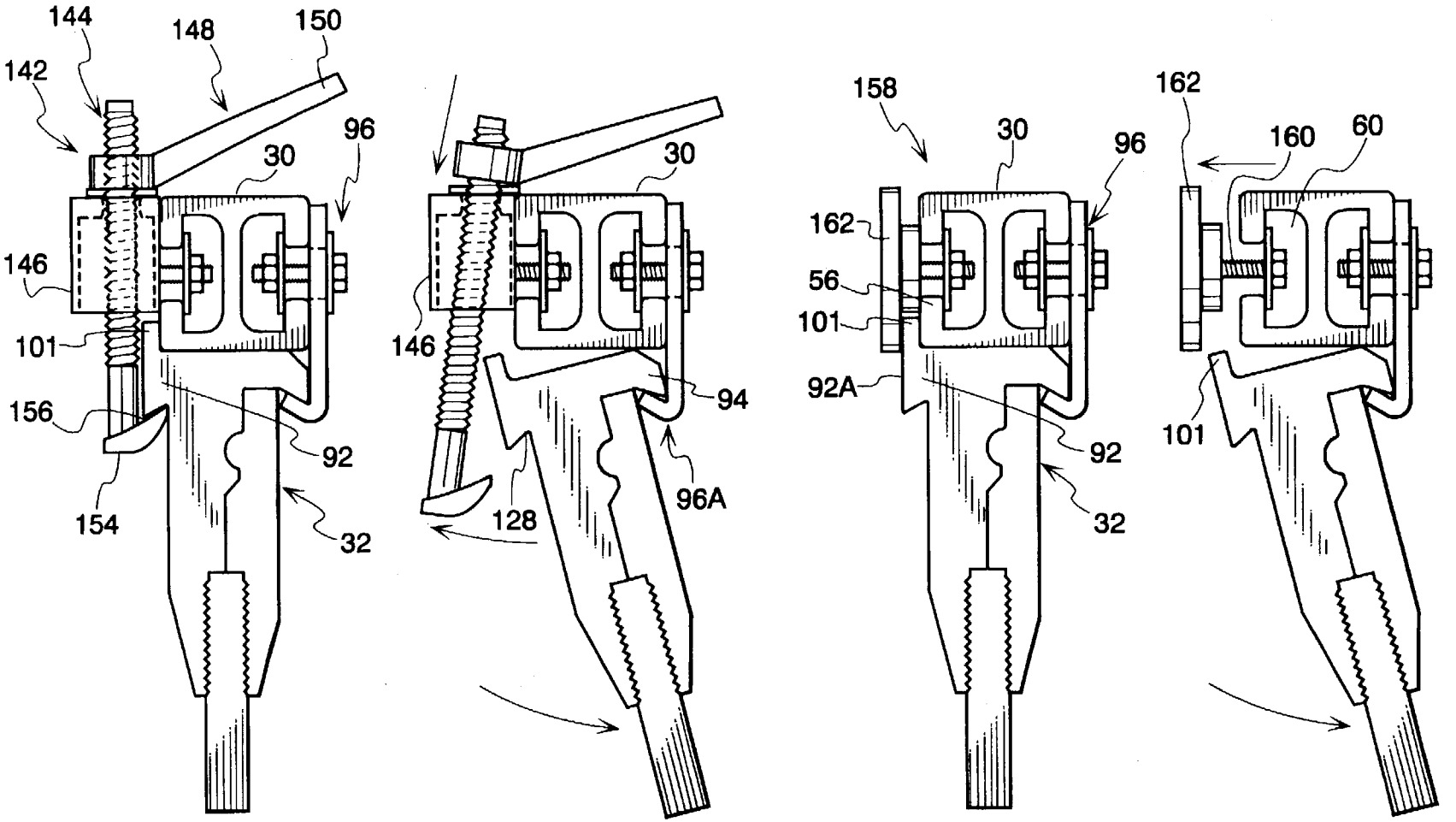
FIG. 9 is an elevational view of an alternative blade mounting assembly according to the present invention having a screw clamping mechanism which includes cam surfaces for engaging and clamping the holder to the mounting bar.
FIG. 10 is an elevational view of the alternative blade mounting assembly of FIG. 9 showing the screw clamp and its cam surfaces moved to the release position disengaged from the holder with the holder pivoted about the pivot member to disengage and remove the blade assembly from the mounting bar.
FIG. 11 is an elevational view of another alternative blade mounting assembly according to the present invention having a different screw clamping mechanism from that of FIGS. 9 and 10 with an enlarged head which engages the holder to clamp it against the mounting bar in the clamping position.
FIG. 12 is an elevational view of the alternative blade mounting assembly of FIG. 11 showing the screw clamp loosened so as to disengage the head from the holder in the clamp release position and to pivot the holder about the pivot member to disengage and remove the blade assembly from the mounting bar.

To clamp the holder 32 to the mounting bar 30, the gripping portion 150 is turned so as to cause the rod 144 to be moved axially upwardly through the mounting block 146 with the cam surface 146 drawn into engagement with the holder 32 engaging in the holder corner channel 128 as it moves axially upwardly. In this manner, the cam surface 156 is effective to apply a clamping force having both horizontal and vertical force components to the holder clamp engaging portion 92 similar to the spring plate 34 for pivoting the pivotally mounted portion 94 about the pivot member end **96*a*, as shown in FIG. 9. To release the screw clamp 142, the handle gripping portion 150 is rotated in the opposite loosening direction so as to cause the rod 144 to move axially downward, thus moving the cam surfaces 156 of the cam member 154 out of engagement in the corner channel 128 of the clamp engaging portion 192, as shown in FIG. 10. This allows the holder 32 to pivoted about the hook end 96*a* and removed from engagement with the bar 30** for replacing blade assemblies.

FIGS. 11 and 12 show another screw clamp 158 mounted to mounting bar 30 and which is operable when screwed in a tightening direction to clamp the holder 32 to the bar 30. More specifically, the clamp screw 158 includes a threaded shank member 160 having an enlarged rotating disc clamping head 162 formed at one end with the other end extending into the T-slot 60 for mounting to a fastening member, as previously described with respect to the mounting of the bracket member 64. Turning the screw head 162 in a tightening direction causes the screw shank 160 to move axially inward in the slot 60 and into engagement with the holder mounting portion 92, and particularly the outer vertical surface portion **92*a* thereof, for clamping its uppermost portion between the screw head 162 and the mounting bar lip 56, as shown in FIG. 11. Thus, the clamping force applied by the screw clamp 158 is only in a horizontal direction. The flange 101 and the pivotally mounted portion 94 of the blade holder are abutted against the bar 30 and pivot member and the bottom surface of the bar 30 is abutted by the holder's upper surface to precisely position the blade holder on the bar. The horizontal clamping force, in conjunction with the positioning surfaces and the forces generated during squeegee printing operations, are sufficient to keep the holder 32, specifically the clamp engaging portion 92 thereof, clamped up flush against the bar 30. To release the screw clamp 158, the screw head 152 is turned in a loosening direction allowing the holder 32 to pivot about the pivot member 96 to disengage the holder from the bar 30**, as previously described.

Figure 15:
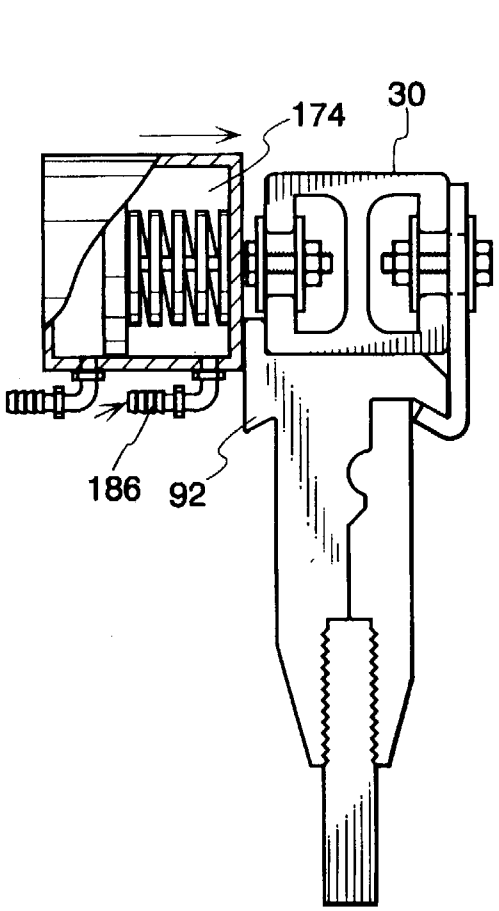
FIG. 15 is an elevational view of the alternative blade mounting assembly of FIGS. 13 and 14 showing the air clamp pressurized so as to move to its clamped position clamping the blade holder against the mounting bar.
Figure 14:
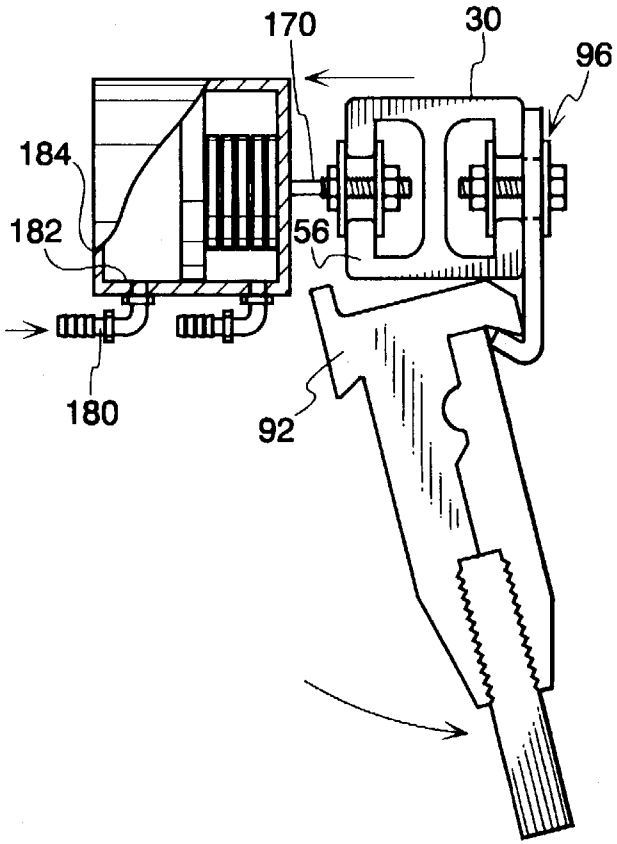
FIG. 14 is an elevational view of the alternative blade mounting assembly of FIG. 13 showing the air clamp pressurized so as to move to its unclamped position for pivoting the blade holder off of the mounting bar.
Figure 13:
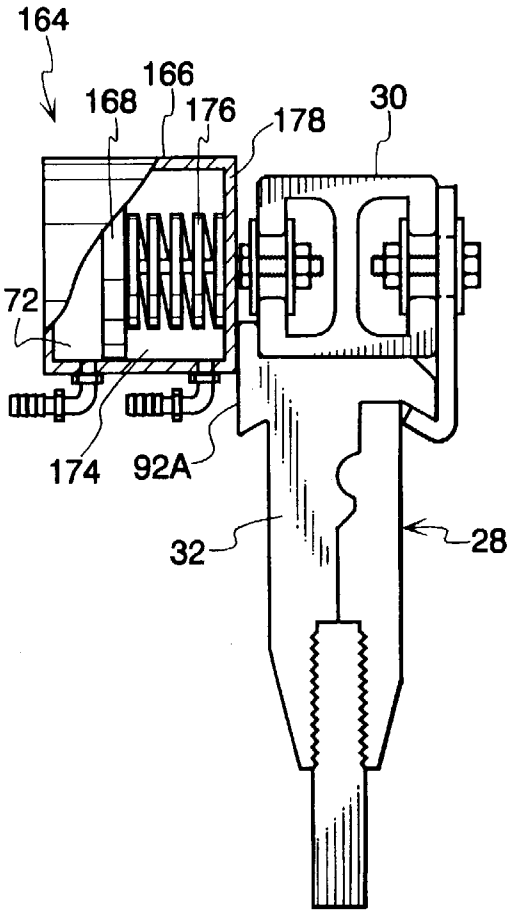
FIG. 13 is an elevational view, partially in section, of another alternative blade mounting assembly according to the present invention having an air clamp in the form of a double-acting cylinder shown in its non-pressurized state.

In FIGS. 13—15, an air clamp 164 is shown for applying a horizontal clamping force against the clamp portion surface **92*a* similar to the screw clamp 158. The air clamp 154 can be in the form of a double-acting cylinder clamp which utilizes both spring loading and air pressure to obtain the clamping force against the clamp engaging portion 92. More specifically, the air clamp 164 includes a cylindrical body housing 166 in which a piston member 168 is mounted with the body 166 being movable in response to air pressure applied thereto. The piston member 168 has a piston rod 170 attached thereto which extends exteriorly of the housing 166 and is attached to the mounting bar 30 in a manner similar to that previously described for the mounting of the other clamping mechanisms. The piston 168 segregates the interior of the body 166 into a rear chamber 172 and a forward chamber 174 with their respective volumes being variable based on the relative position of the piston 168 therein, as described below. A compression spring 176 is coiled about the piston rod 170 in the forward chamber 174 of the cylindrical body 166**.

Thus, when there is no air pressure applied to the body 166, the compression spring 176 is operable to urge the forward wall 178 of the body forward chamber 174 to the right, as seen in FIG. 13, and into engagement with the vertical wall **92*a* of the holder clamp engaging portion 92. In this manner, a light spring load maintains the blade holder 32 in clamping engagement with the mounting bar 30 when the blade assembly 28 is not in use. To change blade assemblies 28 and release the spring clamping pressure on the clamp engaging portion 92 of the holder 32, air pressure is applied to air line 180 and through access port 182 into the rear chamber 172. As the rear chamber 172 is pressurized, the body 166 will be caused to move against the bias of the compression spring 176, in particular with the forward wall 178 pushing against the spring 176 and the back wall 184 moving outwardly away from the piston member 168 to the left to expand the volume of rear chamber 172, as shown in FIG. 4. This movement of the body 166 releases the clamping force applied by its forward wall 178 against the clamp engaging portion 92 and moves the clamp 164 to its unclamped position. Thereafter, the holder 32 can be pivoted about pivot member 96 for changing blade assemblies 28, as previously described. When the blade assembly 28 is to be utilized in a screen printing operation, air pressure can be applied through air line 186 in communication with forward chamber 174 via access port 188. With the chamber 174 pressurized, the air clamp body 166 is caused to move to the right towards the mounting bar 30 to expand the volume of the forward chamber 174, as shown in FIG. 15, with the forward wall 178 clamping tightly against the holder clamp engaging portion 92 with a force greater than that which would be applied by only the spring load provided by spring 176. However, when the air pressure is turned off and the air clamp 164 is in its unpressurized state of FIG. 13, such as when the screen printing machine 10 is not being operated, the clamping force provided by the spring 176 should be sufficient to maintain the captive arrangement of the portion 92 between the cylinder forward wall 176 and mounting bar lip 56**.

Figure 5:
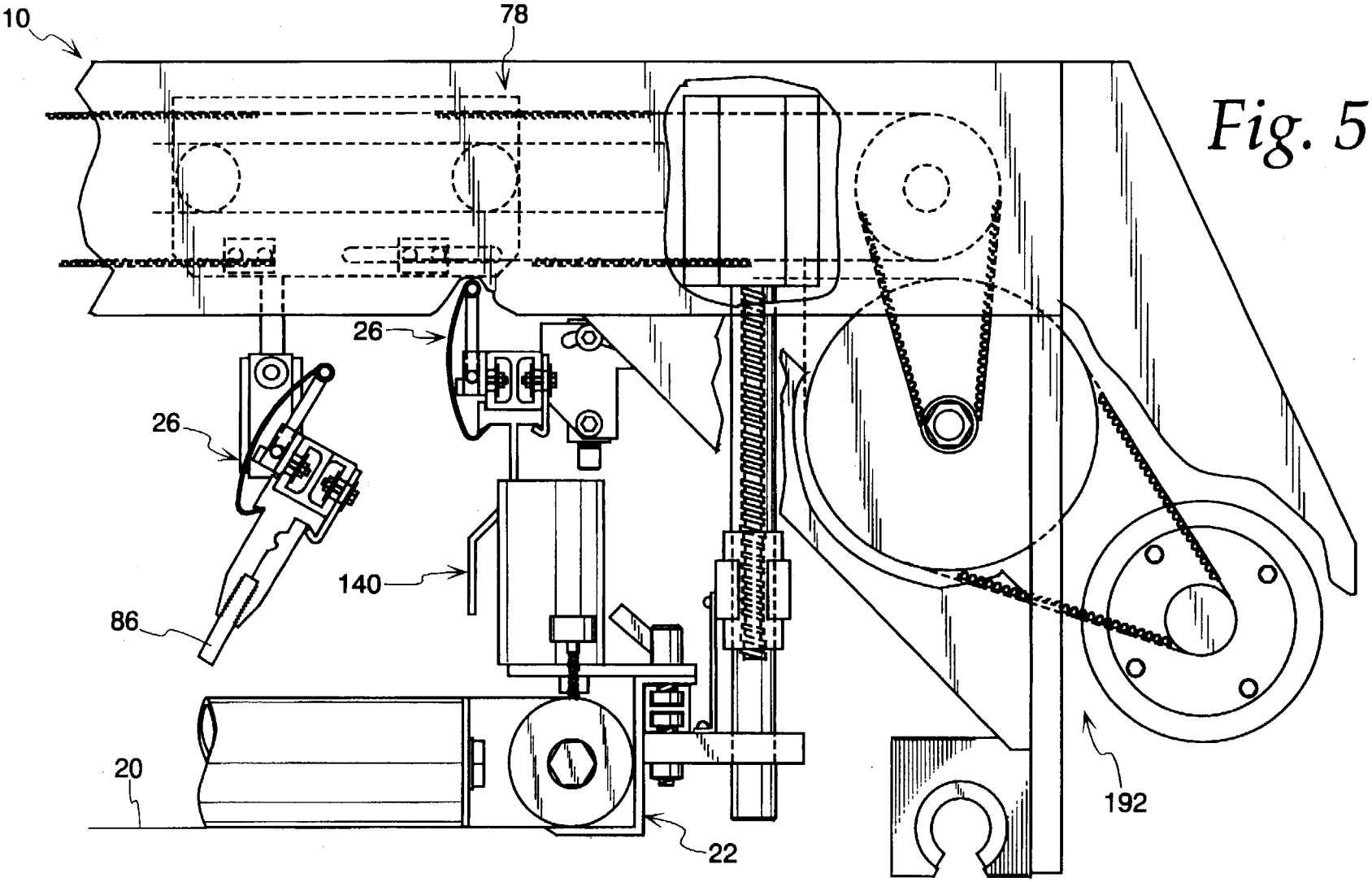
FIG. 5 is an elevational view of a squeegee and flood bar carriage of the screen printing apparatus showing the spring plate clamping mechanism utilized in conjunction with both the squeegee blade and flood bar blade.
Figure 6:
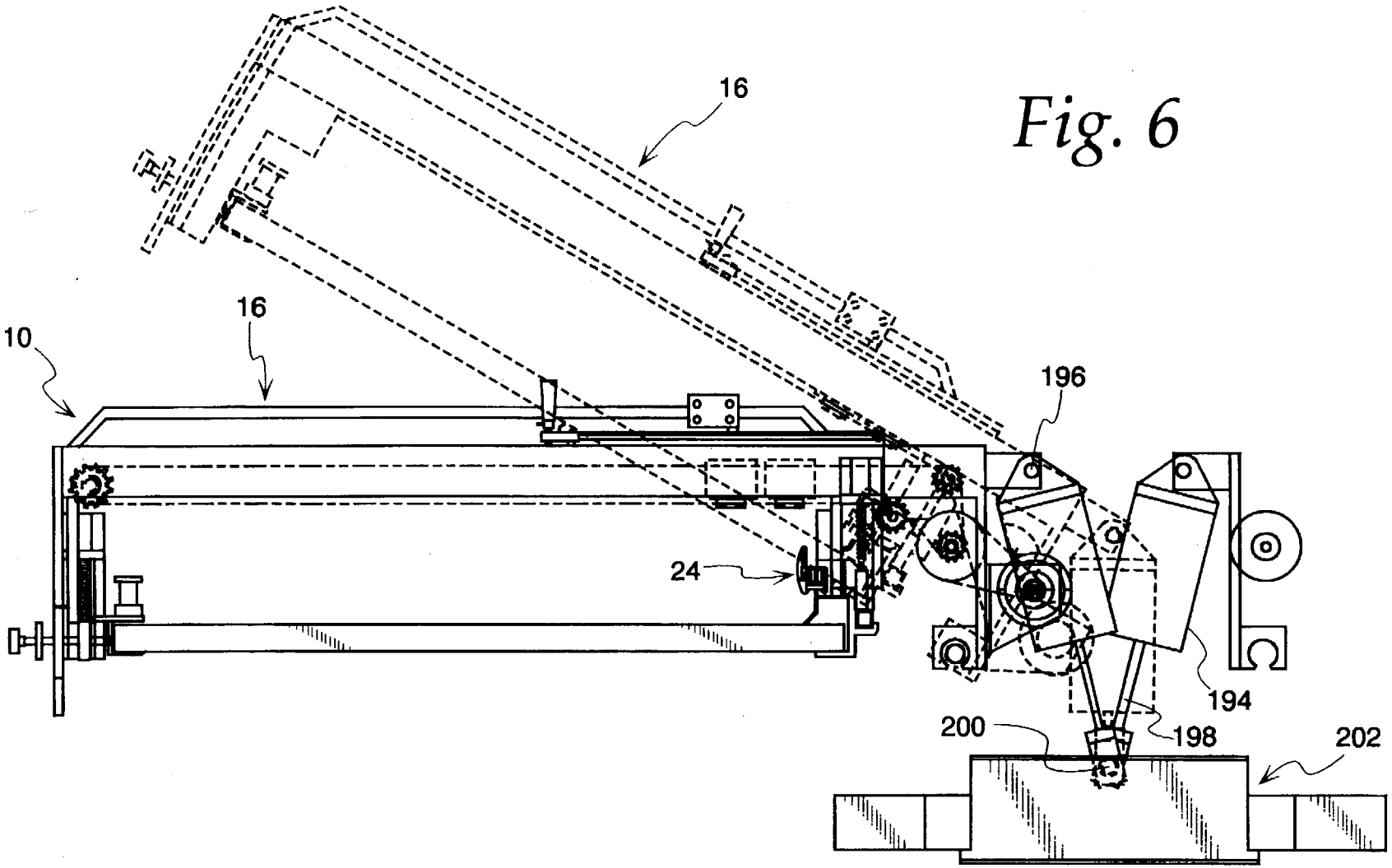
FIG. 6 is an elevational view of the screen printing apparatus showing the print head on which the blade carriage is mounted and shown in ghost pivoted up for access to the bottom of the printing screen.

FIGS. 4–6 show other various details of the screen printing apparatus 10 in which the blade mounting assembly 24 can be utilized. An air clamp 190 is provided for clamping the frame of printing screen 20 to the screen holder 22. The air clamps 190 can be mounted on a slide 191 to allow positioning of the clamps at the best location for clamping of different sizes and kinds of screen frames such as those having square or circular cross-sectional frame members. FIG. 5 more particularly shows details of a drive mechanism for the squeegee and flood bar carriage 18 in the form of a servo motor 192 carried on the printing head 16 to control the speed of and length of carriage travel across the printing screen 20. Finally, FIG. 6 shows means for pivoting the printing heads 16 in the form of an air cylinder 194 connected to the print head 15 by pivot pins 196 and connected at a lower end by its piston rods 198 and pivot pin 200 to the screen printing machine frame 202. Thus, powering of the air cylinder to retract the piston into the cylinder, as shown in dotted lines in FIG. 6, pivots the print head to its raised position for cleaning the screen or to disable the print head when it is not to be used for a particular printing job.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. A blade mounting assembly for releasably securing a holder of a squeegee blade or flood bar blade for a screen printing machine above a printing screen in the machine, the blade mounting assembly comprising:

a mounting bar having a bottom abutment surface for engaging the holder;

a pivot member on the mounting bar projecting below the mounting bar;

a pivotally mounted portion on the holder for releasable engagement with the pivot member;

a clamping mechanism connected to the mounting bar for applying a clamping force to the holder to pivot the pivotally mounted portion about the pivot member and clamp the holder against the mounting bar with the holder against the bottom surface of the bar; and a clamp engaging portion on the holder for releasable engagement with the clamping mechanism and which is moved towards the mounting bar by the clamping mechanism as it pivots the pivotally mounted portion of the holder about the pivot member.

2. The blade mounting assembly of claim 1 wherein the clamping mechanism includes a spring plate with the clamping force being a spring bias clamping force, the spring plate having a bottom end and a pivotable upper end and with the bottom end engaging the holder clamp engaging portion and the upper end pivoted to a clamping position, the pivotally mounted portion is pivoted about the pivot member and the clamp engaging portion is urged by the spring bias clamping force towards the mounting bar.

3. The blade mounting assembly of claim 2 wherein the clamping mechanism includes a bracket secured to the mounting bar and a pivot handle having spaced ends pivotally mounted to the bracket at the ends of the handle and attached to the upper end of the spring plate between the handle ends for pivoting of the handle and attached spring plate upper end.

4. The blade mounting assembly of claim 2 wherein the spring plate upper end is pivoted up to a substantially perpendicular position relative to the mounting bar with the spring plate upper end pivoted to the clamping position to exert the spring bias clamping force on the holder, and the spring plate upper end is pivoted downwardly to a predetermined clamp release and storage position with the spring plate upper end moved down and away from the mounting bar to release the spring clamping force from the holder and to disengage the spring plate bottom end from the clamp engaging portion allowing the holder to be pivoted about the pivot member for moving the holder out of engagement with the mounting bar and removing the holder from the blade mounting assembly while keeping the spring plate connected to the mounting bar.

5. The blade mounting assembly of claim 4 wherein the mounting bar includes a stop member and the clamping mechanism includes a pivot handle which is pivotable relative to the mounting bar and connected to the spring plate upper end, and the pivot handle rests against the stop member with the spring plate hanging over the printing screen spaced outwardly from the mounting bar with the bottom of the spring plate spaced above the screen during blade replacement operations when the spring plate upper end is pivoted to the predetermined release and storage position.

6. The blade mounting assembly of claim 1 wherein the holder includes a clearance providing surface formed between the pivotally mounted and clamp engaging portions thereof to provide clearance space for pivoting of the holder pivotally mounted portion about the pivot member.

7. The blade mounting assembly of claim 1 wherein the mounting bar includes an internally threaded member and the clamping mechanism is a screw clamp having an enlarged head and threaded shank mounted in the internally threaded member such that turning of the head in a tightening clamping direction screws the shank into the threaded member and draws the enlarged head into engagement with the holder clamp engaging portion to apply the clamping force thereagainst in a horizontal direction to clamp the holder against the mounting bar.

8. The blade mounting assembly of claim 1 wherein the clamping mechanism is an air clamp including a body for receiving pressurized air and a clamping member which is moved relative to the mounting bar by applying pressurized air to the body and can be moved into engagement with the holder clamp engaging portion when the clamp body is pressurized to apply the clamping force thereagainst in a horizontal direction to clamp the holder against the mounting bar.

9. The blade mounting assembly of claim 1 wherein the clamping mechanism includes a cam surface which engages the clamp engaging portion for applying the clamping force to the holder and moving the clamp engaging portion towards the mounting bar.

10. A method of releasably mounting squeegee or flood bar blade assemblies to a mounting bar mounted over a printing screen in a screen printing apparatus, the method comprising:

providing a blade holder and a blade in the holder depending therefrom for engaging ink on the printing screen of the screen printing apparatus;

providing a clamping mechanism and a pivot member on the mounting bar;

engaging the holder of the blade assembly with the clamping mechanism to apply a clamping force thereto; and pivoting the holder towards the mounting bar about the pivot member upon engagement and application of the clamping force to the holder for clamping of the holder to the mounting bar.

11. The method of claim 10 wherein the clamping mechanism has a spring plate for applying a spring bias clamping force to the holder to clamp it to the mounting bar.

12. The method of claim 11 wherein the spring plate clamps the holder to the mounting bar by pivoting of the spring plate up to a substantially perpendicular position relative to the mounting bar for exerting the spring bias clamping force to the blade holder, pivoting the spring plate down and outwardly from the mounting bar from the perpendicular position to a predetermined position where it hangs in spaced relation over the printing screen and is disengaged from the holder to remove the spring bias clamping force therefrom, and replacing the blade assembly with a new blade assembly by pivoting the holder about the pivot member downwardly away from the mounting bar to disengage the holder therefrom.

13. In a screen printing apparatus for printing on a substrate utilizing a printing screen fixed over the substrate to be screen printed, a blade assembly which is moved across the printing screen and a clamping mechanism for releasably securing the blade assembly over the screen, the combination comprising:

a blade of the blade assembly for engaging a printing substance to be applied to the substrate through the screen;

a blade holder for mounting the blade and having an upper portion and a lower portion with the blade depending from the holder lower portion;

a mounting bar mounted to the screen printer apparatus above the screen and against which the clamping mechanism releasably secures the blade holder; and a clamp member secured to the mounting bar which stays therewith during blade assembly replacement operations and which is movable between (1) a clamping position wherein the clamp member pushes and clamps the holder upper portion against the mounting bar, and (2) a release position wherein the clamp member is moved to allow the blade holder to be pivoted away from the mounting bar for changing and replacing the blade assembly with another blade assembly without sliding of the clamp member along the bar.

14. The combination of claim 13 wherein the mounting bar includes a pivot member thereon for pivotally mounting the blade holder to pivot the holder against the bar with the clamp member in the clamping position and to pivot the holder away from the bar with the clamp member in the release position.

15. The combination of claim 14 wherein the pivot member has a hook end below the mounting bar which prevents movement of the upper portion down away from the bottom of the mounting bar with the clamp member in the clamping position and in the clamp release position the holder upper portion can be pivoted about the hook end to move the holder away from the mounting bar for replacing blade assemblies.

16. The combination of claim 13 wherein the clamp member is a spring plate pivotally mounted to the mounting bar and with the spring plate in the clamping position, the spring plate exerts a spring bias clamping force to urge the holder upper portion against the mounting bar and pivoting of the spring plate away from the mounting bar and holder to the clamp release position removes the spring bias clamping force from the blade holder allowing the holder to be pivoted away from the mounting bar for replacing blade assemblies.

17. The combination of claim 16 wherein the mounting bar includes a stop thereon for limiting pivoting of the spring plate to allow the spring plate to disengage from the holder and hang over the printing screen spaced outwardly from the mounting bar at a predetermined distance therefrom without engaging the screen during blade assembly replacement operations.

18. The combination of claim 16 wherein the clamp includes a handle pivotally mounted to the mounting bar and which is attached to the spring plate for pivoting thereof.

19. The combination of claim 13 wherein the clamp is one of (1) a screw clamp which is screwed down in the clamping position, and (2) an air clamp which is pressurized in the clamp locking position, with the one of the screw and air clamp pushing the holder upper portion horizontally against the mounting bar in the clamping position.

20. The combination of claim 13 wherein the blade is one of (1) a flexible squeegee which is moved downward into engagement with the printing screen in non-perpendicular relation thereto to force printing ink through the screen as the squeegee is drawn across the screen in a printing operation, and (2) a flood bar which is moved downward to a predetermined position spaced above the screen substantially perpendicular thereto and is moved across the screen in a direction opposite to the movement of the squeegee across the screen to distribute the ink across the screen in a flooding operation prior to the printing operation.

* * * * *